United States Patent [19]

Stits

[11] Patent Number: 4,559,975

[45] Date of Patent: Dec. 24, 1985

[54] HIGH TENACITY POLYESTER FILAMENT FABRIC

[76] Inventor: Raymond M. Stits, P.O. Box 3084, Riverside, Calif. 92519

[21] Appl. No.: 350,080

[22] Filed: Feb. 18, 1982

[51] Int. Cl.[4] ..... D03D 15/00

[52] U.S. Cl. ..... 139/420 R; 428/224

[58] Field of Search ..... 428/224, 225, 229, 257, 428/221; 139/420 A, 420 R, 426 R

[56] References Cited

U.S. PATENT DOCUMENTS

| | | | |
|---|---|---|---|
| 3,337,389 | 8/1967 | Goulding et al. | 428/229 |
| 3,373,774 | 3/1968 | Cruz | 139/426 R |
| 4,209,559 | 6/1980 | Wada et al. | 428/224 |
| 4,298,643 | 11/1981 | Miyagana et al. | 428/229 |
| 4,405,341 | 9/1983 | Jaschek et al. | 428/252 |

OTHER PUBLICATIONS

Du Pont Textile Fibers–Bulletin D 159–Oct. 1962.

*Primary Examiner*—James J. Bell

*Attorney, Agent, or Firm*—John H. Crowe

[57] ABSTRACT

A finely woven, shrinkable fabric of square-weave pattern suitable for use in the covering of aircraft frames. The fabric is formed entirely from high tenacity polyester filaments, preferably of 70-denier size. When so formed, it is significantly superior in properties of strength and elongation under load to fabrics made from regular tenacity, 70-denier polyester filaments. Such 70-denier fabrics made from regular tenacity polyester filaments do not meet the FAA requirements for aircraft cover utility, however. Consequently, although regular tenacity polyester filament fabrics have heretofore been used for aircraft cover purposes, in order to meet FAA requirements for such usage they have had to be substantially coarser and heavier than the high tenacity, 70-denier fabric of this invention.

4 Claims, No Drawings

HIGH TENACITY POLYESTER FILAMENT FABRIC

BACKGROUND OF THE INVENTION

This invention relates generally to fabrics useful as covering materials for various types of frame structures and for other purposes, and more particularly to such fabrics of high strength, lightweight character especially suitable for use in the covering of aircraft frames.

For many decades, fabrics of one sort or another have been employed as airframe covering materials. Since about the mid-fifties, polyester fabrics have been widely utilized for this purpose. A suitable fabric for such usage must meet certain strength and elongation standards set by the Federal Aviation Administration (FAA), and in order to do this, the polyester fabrics heretofore employed have been woven from threads formed from relatively thick filaments which has resulted in coarse, fairly heavy fabric materials. Polyester fiber was initially defined by the Federal Trade Commission (which classifies and controls the marketing of fibers in the United States) as "a manufactured fiber in which the fiber-forming substance is any long-chain polymer composed of at least 85% by weight of an ester of dihydric alcohol and terephthalic acid." In the late 70's, however, the FTC amended the definition to read: "polyester is a manufactured fiber in which the fiber-forming substance is any long-chain synthetic polymer composed of at least 85% by weight of an ester of the substituted aromatic carboxylic acids, including but not restricted to substituted terephthalate units and parasubstituted hydroxybenzoate units."

In the production of polyester fabric, hot, molten material of suitable polymeric composition is first extruded through a spinneret to form it into filaments. The filaments, after cooling, are heated and stretched to reduce their size to a desired denier and strengthen them through alignment of their molecules along the filament axes (the denier of a filament being the weight in grams of a segment thereof 9,000 meters long). The stretched filaments are combined into threads, cooled under tension and then spooled and routed to weaving mills where they are woven into fabric after being coated with a lubricant to prevent wear and breakage during the weaving procedure. The woven fabric, as it comes from the looms, is referred to a greige goods.

Heretofore, polyester fabrics have been manufactured in large quantities for use in the apparel industry where they are formed into various articles of clothing. Where a polyester greige fabric is to be so employed, it is first heated in air at from about 350° to about 375° F. under controlled tension to stabilize its filaments, then further processed in various ways for numerous applications. The polyesters heretofore employed for airframe covering purposes are the same chemically as polyester apparel fabrics, but they are made physically strong enough to meet the above-mentioned FAA requirements. This, as previously indicated, results in a material of relatively heavy and coarse-textured character, which characteristics detract from its overall effectiveness as an airframe covering material.

Various methods of covering an aircraft frame with a heat-shrinkable fabric such as polyester greige fabric are well known to those skilled in the art and need not be described in detail here. All such methods involve the basic steps of fastening the fabric to the frame and then heating it to shrink the fabric filaments and thereby cause the fabric cover to be pulled taut on the frame. The preferred heating temperature is about 350° F., this having been found optimum for the development of suitable tension in the polyester filaments. Other temperatures, within certain limits, will also result in shrinkage of the polyester filaments. Temperatures of 375° F. and above, however, have been found to soften the filaments and cause them to release their tension.

Those polyester fabrics heretofore employed as airframe covering materials have all been formed from filaments classified as "regular tenacity" filaments, typical examples of which normally exhibit an elongation up to 40% before breaking. This amount of stretch is undesirable in an airframe cover where a strength of 80 pounds per inch and an elongation of only 14% at 70 pounds per inch load is required under the FAA standards mentioned above. It is therefore necessary that the polyester thread filaments be of large enough size, and the thread count high enough, to meet these high strength, low elongation requirements. Thus, the smallest filament for aircraft cover suitability has heretofore been found to be of 150-denier size. Tests have shown that a fabric woven with threads formed from 34, 150-denier filaments and having 66 threads per inch, warp and fill, will narrowly pass the minimum FAA requirements for airframe cover utility. Such a fabric has a weight of approximately 2.7 oz. per square yard.

SUMMARY OF THE INVENTION

I have now, by means of this invention, succeeded in providing finely woven, lightweight polyester fabrics particularly suitable for use in the covering of airframes. My novel fabrics have high strength and low elongation properties, in spite of their finely woven texture, and can be shrunk in place on airframes by the application of heat alone, without the application of any dope.

The fabrics of this invention owe their unique physical properties to the fact that they are formed from high tenacity polyester filaments and are of balanced weave style, by which is meant they are woven with substantially equal numbers (within about 10 counts) of warp and fill threads. Preferably, the fabrics have equal warp and fill thread counts to thereby form square weave patterns.

High tenacity polyester filaments, per se, have been commercially available for some time as high strength, low elongation filaments. They differ chemically from regular polyester filaments, and, as just indicated, are physically distinguishable therefrom by their superiority in strength and elongation properties. Tenacity is a term used to define the strength of a filament, yarn, cord or fiber and is the force per unit of linear density. Filaments with a tenacity rating above 6 grams per denier (gpd) are generally considered to be high tenacity and those below 6 gpd to be regular tenacity.

Heretofore, fabrics made from high tenacity polyester filaments have been employed in such products as boat sails, V-belts, awnings, pool covers, and other protective covers. These applications have all involved the use of coarse, heavy polyester threads. Moreover, all previous fabrics made from high tenacity polyester filaments have had high tenacity threads in only the warp direction, for high strength lengthwise, regular tenacity filaments having been used for the fill threads, and have been characterized by unbalanced thread counts.

It is thus a principal object of this invention to provide a heat shrinkable fabric of finely woven character having properties of high strength and low elongation under load, particularly suitable as an airframe covering material.

It is another object of the invention to provide such a fabric which can be shrunk to a taut condition on an airframe by heat treatment alone.

Another object of the invention is to provide such a fabric having general superiority over fabrics heretofore employed for airframe covering purposes.

Other objects, features and advantages of the invention will become apparent in the light of subsequent disclosures herein.

DESCRIPTION OF THE PREFERRED EMBODIMENT:

After much experimentation with various fabric styles having high tenacity polyester filaments in both directions in a balanced weave fabric, I have discovered that a 94 by 94 thread count fabric made from 70-denier filaments, with 34 filaments per thread, has a breaking strength of over 90 pounds per inch width and an elongation of 11% at the required 70 pounds per inch test load. This fabric weighs about 1.7 oz. per square yard. A comparison of that weight with the 2.7 oz. per square yard weight of the previously mentioned regular tenacity polyester fabric shows an increase of the latter thereover of about 59% and pinpoints a substantial weight advantage in my novel fabric over those polyester fabrics heretofore employed in airframe covers.

As previously indicated, my high tenacity polyester filament fabrics have significantly improved strength and elongation characteristics, by comparison with regular tenacity polyester filament fabrics. As evidence of this, tests on one-inch wide 90 thread count, 70-denier specimens of each type of fabric were run under my direction with the following results:

| Filament Tenacity | Strength at Breaking | Elongation at Breaking |
|---|---|---|
| Regular | 68 lbs. | 29% |
| High | 86.4 lbs. | 15.99% |

These results illustrate a 27% strength improvement in the high tenacity over the regular tenacity material and an elongation in the regular tenacity fabric 81% greater than the elongation of the high tenacity fabric.

From the foregoing, it will be apparent that the weight of my preferred polyester fabric made from high tenacity filaments is not much more than half the weight of the lightest regular tenacity polyester filament fabric capable of meeting the required strength and elongation standards for aircraft cover usage. It will also be apparent that the high tenacity filament fabric is of much finer weave, hence smoother, than its regular tenacity filament counterpart, as a result of which it requires less coating than the latter in the aircraft covering process. This results in an even greater improvement in fabric weight on a finished aircraft, by comparison with the more heavily coated, heavier weight regular tenacity filament fabrics. It also results in lower cost to develop the ultra-smooth finish required for the reduction of air drag at high speed flight.

The high tenacity fabric styles of this invention can be affixed to aircraft frames in the same manner as can regular tenacity fabric materials. Either the envelop or blanket technique, for example, can be employed for this purpose and attachment of the fabric to the frame can be achieved by mechanical means, by sewing or with cement. After the fabric is fastened to an airframe, it can be subjected to controlled heat (preferably at 350° F.) to cause it to shrink and become taut on the frame. Any method of applying heat can be employed for this purpose. A preferred way of heating is by means of a domestic iron with suitable temperature controls to adjust the temperature within a range of 200° to 350° F. The fabric can be partly or completely precoated with a nontauting coating preparation prior to being attached to the airframe, or it can be first fastened to the frame, subjected to heat to render it taut, and then coated.

Although I have herein stressed the qualities of low weight and fine weave structure in my novel high tenacity polyester fabrics, it should be understood that the value of each of these qualities is measured by reference to comparative regular tenacity polyester fabrics. Thus, the present invention encompasses a spectrum of suitable fabrics having a variety of weights and thread sizes to suit them for specific purposes. An example of such a greige fabric of coarser weave than the fine-weave fabric described above, which I have found suitable for heavy duty aircraft cover purposes, is one formed from 125-denier filaments of 80 by 80 thread count (34 filaments to a thread), weighing 2.7 oz. per square yard. This fabric has a tensile strength of 135 pounds per inch, warp and fill.

While the present disclosure has been primarily directed to the use of high tenacity polyester filament fabrics as airframe covering materials, it should be understood that my invention is not so limited, and is broad enough in scope to include fabrics suitable for other purposes as well. Thus, balanced fabrics made from high tenacity filaments of any denier, but preferably from about 40- to about 150-denier, and woven in any style with a thread count of from about 50 to about 120, all fall within the scope of the invention. Examples of useful applications for such fabrics include, but are not limited to, rigid airfoil shaped boat sails or "wings"; kayak, boat or canoe covering; vehicle body to provide a shape for lightweight ground vehicles; kites (including man carrying kites); trampolines; shelters, portable buildings or structure coverings; portable safety, emergency or rescue apparatus and exit slide chutes; pontoons, floats and life rafts or air bags; gas or liquid storage bags; and hot air balloons and dirigibles. Most, but not all, of these fabrics for other than airframe cover use are greige fabrics that have not been pre-shrunk. In exceptional cases, however, pre-shrunk fabrics will be required, and these are within the scope of my invention, which is limited only by the language of the claims to follow.

I claim:

1. A balanced weave greige fabric formed from high tenacity polyester filaments particularly suitable for use as an aircarft cover fabric, said filaments being of from about 40- to about 150- denier size and said fabric having a thread count from about 70 to about 100 threads per inch, warp and filling, and a weight no greater than about 3 ounces per square yard.

2. A greige fabric in accordance with claim 1 of square-weave style.

3. A greige fabric in accordance with claim 2 having a thread count of 94 threads per inch, warp and filling, and a weight of about 1.7 ounces per square yard.

4. A greige fabric in accordance with claim 2 having a thread count of 80 threads per inch, warp and filling, and a weight of about 2.7 ounces per square yard.

* * * * *